US010334996B2

(12) United States Patent
Tedesco et al.

(10) Patent No.: US 10,334,996 B2
(45) Date of Patent: Jul. 2, 2019

(54) PAPER DISPENSER AND RELATED METHODS

(71) Applicant: SCA Hygiene Products AB, Gothenburg (SE)

(72) Inventors: Daniele Salvatore Tedesco, North Wales, PA (US); Craig Michael Billman, Phoenixville, PA (US); Michael Austin Dotsey, Chester Springs, PA (US); Bryan Fitzgerald Allard, West Chester, PA (US)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 96 days.

(21) Appl. No.: 15/415,908

(22) Filed: Jan. 26, 2017

(65) Prior Publication Data

US 2018/0206684 A1 Jul. 26, 2018

(51) Int. Cl.
*A47K 10/32* (2006.01)
*A47K 10/38* (2006.01)

(52) U.S. Cl.
CPC .. *A47K 10/3818* (2013.01); *A47K 2010/3206* (2013.01); *A47K 2010/3233* (2013.01)

(58) Field of Classification Search
CPC ..... A47K 10/38; A47K 10/3818; A47K 2010/3206
See application file for complete search history.

(56) References Cited

U.S. PATENT DOCUMENTS 5,141,171 A * 8/1992 Yang ..... A47K 10/3818 206/233
5,215,211 A * 6/1993 Eberle ..... A47K 10/3818 221/1

(Continued)

FOREIGN PATENT DOCUMENTS

CA 2044188 12/1991
CA 2073931 A1 1/1993

(Continued)

OTHER PUBLICATIONS

International Search Report and Written Opinion dated Apr. 23, 2018 issued in corresponding International application No. PCT/EP2018/051185.

(Continued)

*Primary Examiner* — William A. Rivera
(74) *Attorney, Agent, or Firm* — Drinker Biddle & Reath LLP

(57) ABSTRACT

An apparatus for dispensing paper product has an encasement that is configured to enclose the roll of paper. The encasement has a base at a longitudinal end for supporting the roll of paper in that encasement, with the base including a base opening for the paper to be inserted there through. The base also has an inner surface that is configured to contact the roll of paper, as well as an oppositely disposed outer surface. A dispensing portion of the apparatus is located adjacent the outer surface of the base, and is releasably coupled to the encasement. Coupling between the dispensing portion and the encasement is free of fasteners.

(Continued)

The dispensing portion includes a rotatable dispensing element that has a dispensing orifice for dispensing paper from within said encasement to the exterior.

28 Claims, 12 Drawing Sheets

(56) References Cited

U.S. PATENT DOCUMENTS

| | | | | |
|---|---|---|---|---|
| 5,246,137 | A * | 9/1993 | Schutz | A47K 10/3818 206/409 |
| 5,263,607 | A * | 11/1993 | Temesvary | A47K 10/3818 221/304 |
| 5,273,184 | A * | 12/1993 | Rizzuto | A47K 10/3818 221/286 |
| 5,370,338 | A | 12/1994 | Lewis | |
| 6,010,090 | A | 1/2000 | Bushmaker et al. | |
| 6,029,921 | A | 2/2000 | Johnson | |
| 6,089,499 | A | 7/2000 | Robinson | |
| 6,109,473 | A | 8/2000 | Neveu et al. | |
| 6,129,240 | A | 10/2000 | Morand | |
| 6,267,321 | B1 | 7/2001 | Tramontina | |
| 6,510,964 | B2 | 1/2003 | Paukov et al. | |
| 6,575,397 | B1 | 6/2003 | Tramontina et al. | |
| 6,769,589 | B2 | 8/2004 | Paukov | |
| 7,025,301 | B1 * | 4/2006 | Notarnicola | A47K 10/3818 242/593 |
| 7,510,137 | B2 | 3/2009 | Tramontina et al. | |
| 8,741,410 | B2 | 6/2014 | Cattacin et al. | |
| 9,409,745 | B2 | 8/2016 | Walgenwitz et al. | |
| 9,687,125 | B2 * | 6/2017 | Marietta-Tondin | A47K 10/3818 |
| 2002/0056718 | A1 * | 5/2002 | Paukov | A47K 10/3818 221/63 |
| 2005/0067519 | A1 | 3/2005 | King | |
| 2005/0129898 | A1 | 6/2005 | Sosalla | |
| 2011/0177278 | A1 | 7/2011 | Neto et al. | |
| 2012/0223175 | A1 | 9/2012 | Billman et al. | |
| 2015/0048105 | A1 | 2/2015 | Gordon | |
| 2015/0122937 | A1 * | 5/2015 | Marietta-Tondin | A47K 10/3818 242/593 |

FOREIGN PATENT DOCUMENTS

| | | | |
|---|---|---|---|
| EP | 0595779 | A1 | 5/1994 |
| EP | 0836825 | B1 | 5/2002 |
| EP | 2583602 | A1 | 4/2013 |
| EP | 2606795 | A1 | 6/2013 |
| FR | 2761252 | A1 | 10/1998 |
| FR | 2907654 | A1 | 5/2008 |
| FR | 2917396 | A1 | 12/2008 |
| WO | WO-98/25848 | A1 | 6/1998 |
| WO | WO-2008/142582 | A2 | 11/2008 |
| WO | WO-2012/079627 | A1 | 6/2012 |
| WO | WO-2012/146300 | A1 | 11/2012 |
| WO | WO-2013/093596 | A1 | 6/2013 |
| WO | WO-2013/184049 | A1 | 12/2013 |
| WO | WO-2014/003618 | A1 | 1/2014 |

OTHER PUBLICATIONS

International Preliminary Report on Patentability dated Apr. 18, 2019 issued in international application No. PCT/EP2018/051185.

* cited by examiner

PAPER DISPENSER AND RELATED METHODS

TECHNICAL FIELD

The present disclosure is generally related to dispensers and, more particularly, to dispensers of paper product and methods for dispensing such paper product.

SUMMARY

In one embodiment, an apparatus is disclosed for dispensing paper product from a roll of paper. The apparatus has an encasement that is configured to enclose the roll of paper. The encasement has a base at a longitudinal end for supporting the roll of paper in that encasement, with the base including a base opening for the paper to be inserted there through. The base also has an inner surface that is configured to contact the roll of paper, as well as an oppositely disposed outer surface. A dispensing portion of the apparatus is located adjacent the outer surface of the base, and is releasably coupled to the encasement. Coupling between the dispensing portion and the encasement is free of fasteners. The dispensing portion includes a rotatable dispensing element that has a dispensing orifice for dispensing paper from within the encasement to the exterior.

The dispensing portion also has a housing first opening adjacent and in flow communication with the base opening, and in flow communication with the dispensing orifice for receiving the paper there through. Additionally or alternatively, the dispensing portion may be directly coupled to the outer surface of the base. In specific embodiments, the dispensing portion and the encasement are slidably coupled to one another. In specific embodiments also, one of the dispensing portion or the encasement has a pair of flange portions, while the other of the dispenser portion or the encasement has a corresponding pair of tracks that are configured to receive the pair of flange portions along those tracks, so as to provide sliding movement of the dispensing portion and the encasement relative to one another. In specific embodiments, the flange portions form part of the dispensing portion, while the tracks form part of the encasement. The tracks may be defined by a pair of ledges that extend from the outer surface of the base, with each of the ledges have a generally L-shaped cross-section. The dispensing portion may include a latch for selectively restricting sliding movement of the dispensing portion and the encasement relative to one another, with the latch having a first position in which sliding movement of the dispensing portion and the encasement relative to one another is permitted. A second position of the latch is such that sliding movement of the dispensing portion and the encasement relative to one another is restricted.

The latch, in specific embodiments, includes a protrusion, while the base includes a slot that is configured to receive the protrusion therein, with the protrusion being biased toward the second position of the latch. In some embodiments, the rotatable dispensing element includes generally dome-shaped body. In some embodiments also, the dispensing portion includes a housing, with the rotatable dispensing element being releasably retained within that housing. The housing may include first and second housing parts that are releasably coupled to one another, with releasable coupling between the first and second housing parts being, in specific embodiments, free of fasteners. The first housing part may include at least one first arcuate guiding surface that is shaped so as to conform to an outer surface of the rotatable dispensing element, and configured to guide movement of the rotatable dispensing element within the housing.

The first housing part may include a stopping element extending from the at least one first arcuate guiding surface, with the stopping element being configured to restrict movement of the rotatable dispensing element beyond a predetermined position. Additionally or alternatively, the second housing part may include at least one second arcuate guiding surface that is shaped so as to conform to the outer surface of the rotatable dispensing element. In such embodiments, the at least one second arcuate guiding surface cooperates with the at least one first arcuate guiding surface of the first housing part, so as to jointly guide movement of the rotatable dispensing element along those surfaces. The dispensing portion may include a housing supporting the dispensing element and which includes a housing second opening, with the rotatable dispensing element protruding through and being rotatable relative to that housing second opening, and with the housing first and second openings lying on respective first and second planes that are transverse to one another.

In embodiments having first and second housing parts, as described above, those two housing parts may be slidably coupled to one another. Additionally or alternatively, one of the first or second housing parts may include one or more bosses, while the other of the first or second housing parts may include a corresponding number of apertures that are configured to receive the one or more bosses in them, so as to guide positioning of the first and second housing parts relative to one another. The dispensing portion may include a guiding element that is disposed within the rotatable dispensing element and having one or more angled guiding surfaces for guiding paper from the base opening toward the dispensing orifice. The guiding element, in specific embodiments, is releasably coupled to the rotatable dispensing element.

In another embodiment, an apparatus is provided for dispensing paper product from a roll of paper. The apparatus includes an encasement that is configured to enclose the roll of paper, and having a base at a longitudinal end of that encasement, for supporting the roll of paper in the encasement. The base includes a base opening for the paper to be inserted there through, and an inner surface that is configured to contact the roll of paper. The base also includes an outer surface disposed opposite the inner surface of the base. A dispensing portion of the apparatus is located adjacent the outer surface of the base and is slidably coupled to the encasement. The dispensing portion includes a rotatable dispensing element having a dispensing orifice at an end of that rotatable dispensing element for dispensing paper from within the encasement to the exterior.

The rotatable dispensing element has multiple degrees of freedom for movement of that rotatable dispensing element relative to the rest of the dispensing portion. The dispensing portion also has a housing first opening adjacent and in flow communication with the base opening, and in flow communication with the dispensing orifice, for receiving the paper there through. Coupling between the encasement and the dispensing portion in the embodiment described above may additionally be free of fasteners. Additionally or alternatively, the dispensing portion may have a housing second opening, with the rotatable dispensing element protruding through and being rotatable relative to that housing second opening. In that type of embodiment, the housing first and second openings may lie on respective first and second planes that are transverse to one another.

In yet another embodiment an apparatus is disclosed for dispensing paper product from a roll of paper. An encasement of the apparatus is configured to enclose the roll of paper, with the encasement extending along a longitudinal axis. The encasement has a base at a longitudinal end for supporting the roll of paper therein. The base includes a base opening for the paper to be inserted there through, an inner surface that is configured to contact the roll of paper, and also an opposite outer surface. The apparatus further includes a dispensing portion adjacent the outer surface of the base and having a dispensing orifice for dispensing paper to the exterior. The dispensing portion is slidably coupled to the encasement for selectively joining and separating the encasement and the dispensing portion relative to one another.

The dispensing portion, in specific embodiments, includes a rotatable dispensing element that has includes the dispensing orifice. Additionally or alternatively, slidable coupling between the encasement and the dispensing portion may permit slidable movement of the encasement and the dispensing portion, relative to one another, in a direction that is transverse to the longitudinal axis. Further, slidable coupling between the encasement and the dispensing portion may permit slidable movement of the encasement and the dispensing portion, relative to one another, in a direction that is substantially orthogonal to the longitudinal axis.

BRIEF DESCRIPTION OF THE DRAWINGS

The objectives and features of the invention will become more readily apparent from the following detailed description taken in conjunction with the accompanying drawings in which.

DETAILED DESCRIPTION OF PARTICULAR EMBODIMENTS

To the extent that any meaning or definition of a term in this written document conflicts with any meaning or definition of the term in a document incorporated by reference, the meaning or definition assigned to the term in this written document shall govern. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Also, as used herein, the term "releasable coupling" and related terms refer to a type of coupling in which the coupled structures may be readily detached, decoupled, or otherwise separated from one another in a simple manner and without causing the destruction or damage of any of those structures. For sake of further explanation, a permanent—rather than "releasable"—type of coupling may refer, for example, to two structures that are integrally formed with one another, or which are adhesively attached, such that their separation would necessarily result in at least some level of damage to one or more of the parts being separated.

Figure 1:
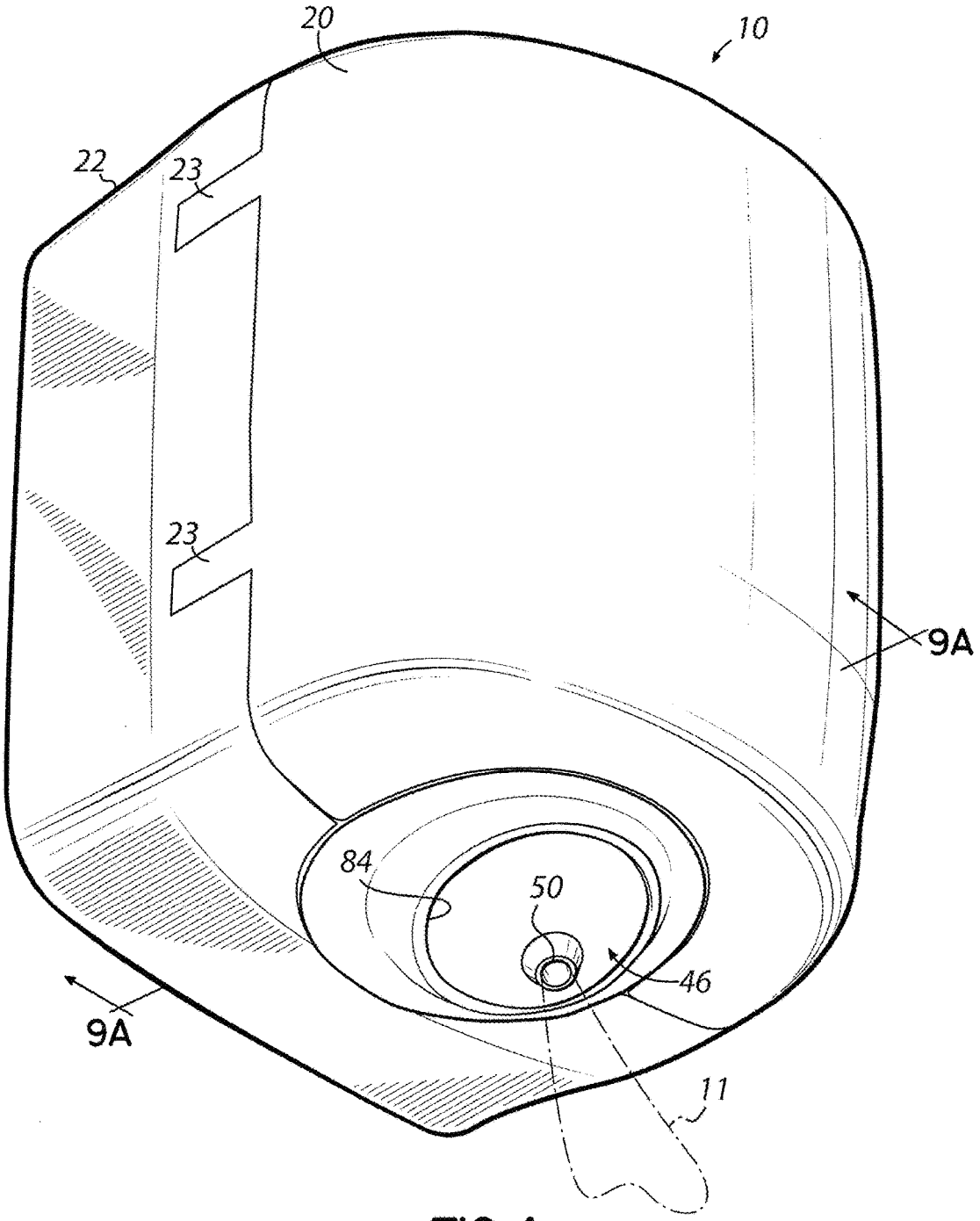
FIG. 1 is a perspective view of an apparatus for dispensing paper product in accordance with one embodiment of the invention.
Figure 2:
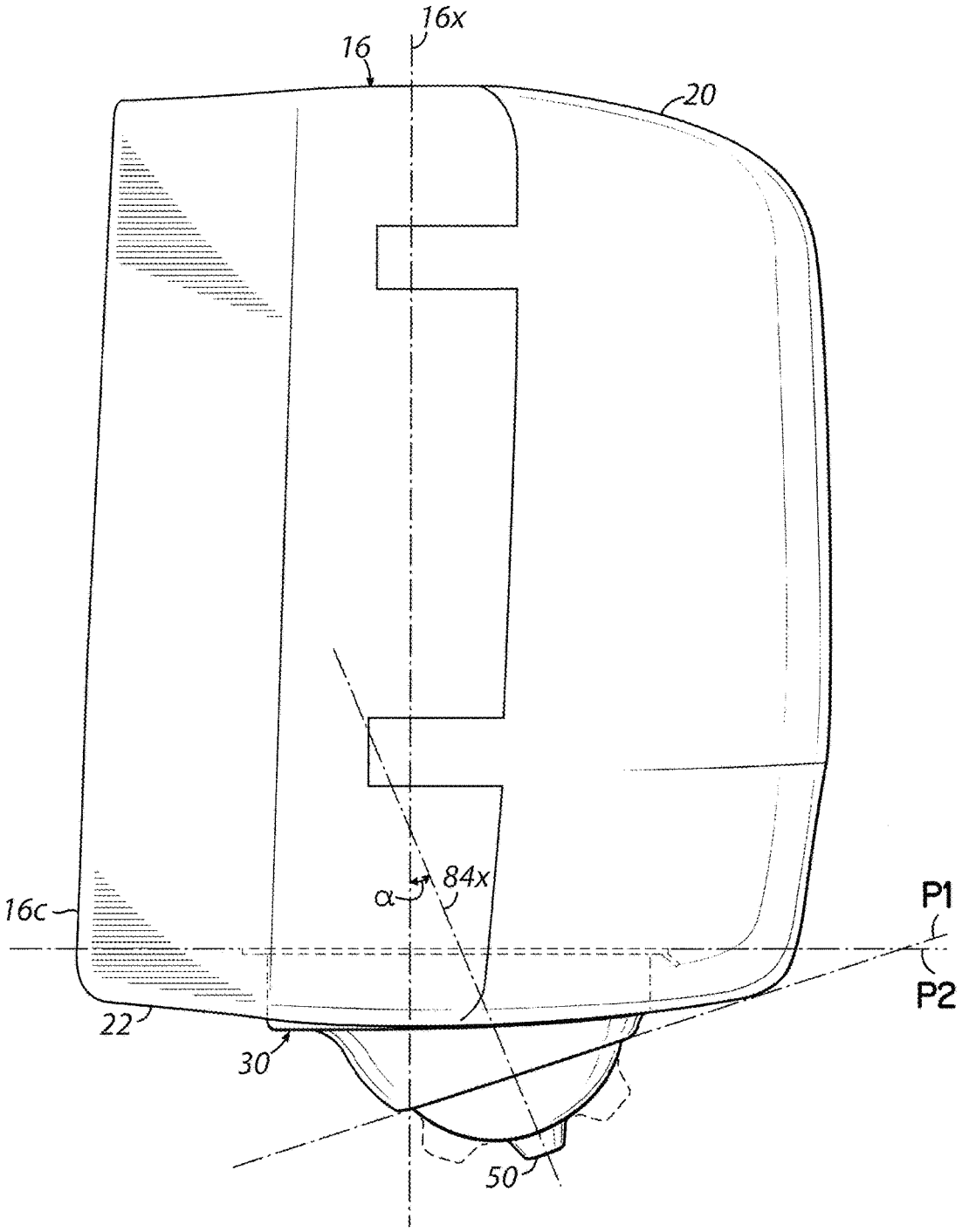
FIG. 2 is an elevation side view of The apparatus of FIG. 1.
Figure 3:
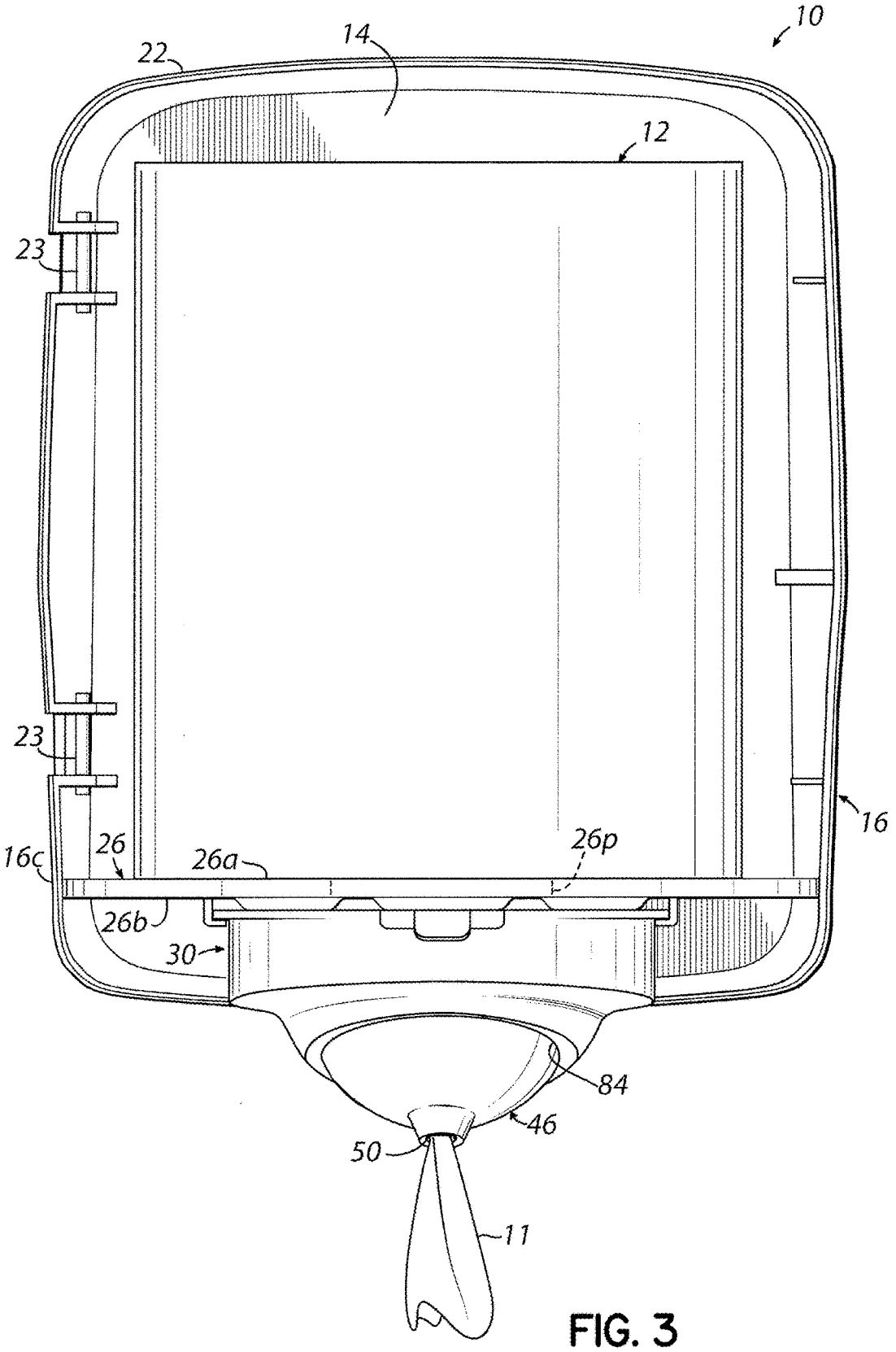
FIG. 3 is a front view of a portion of The apparatus of FIGS. 1 and 2, illustrating an interior of that dispenser and a roll of paper product therein.
Figure 4:
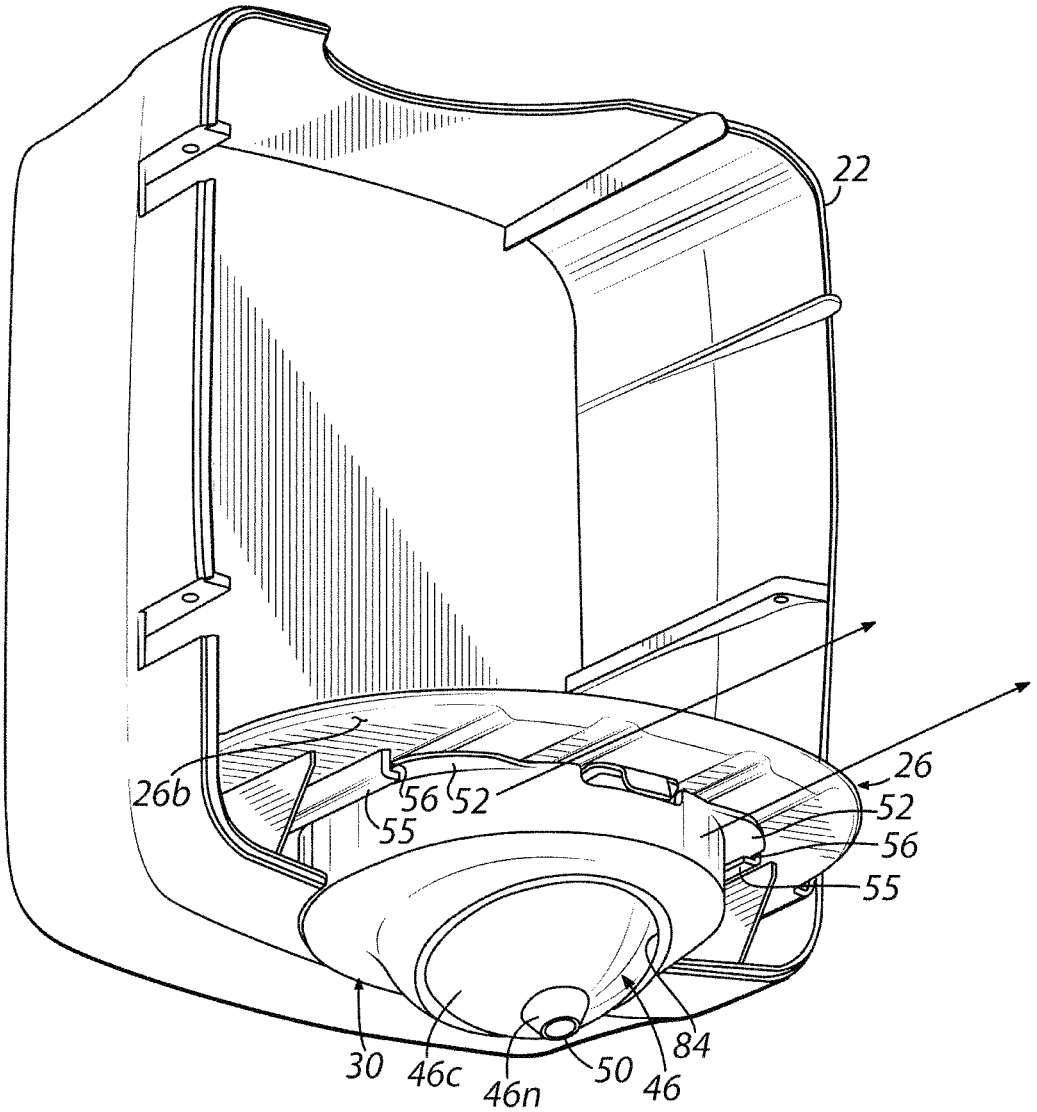
FIG. 4 is a perspective view of the portion of the dispenser shown in FIG. 3, illustrating the interior of that dispenser and movement of a dispensing portion thereof.
Figure 5:
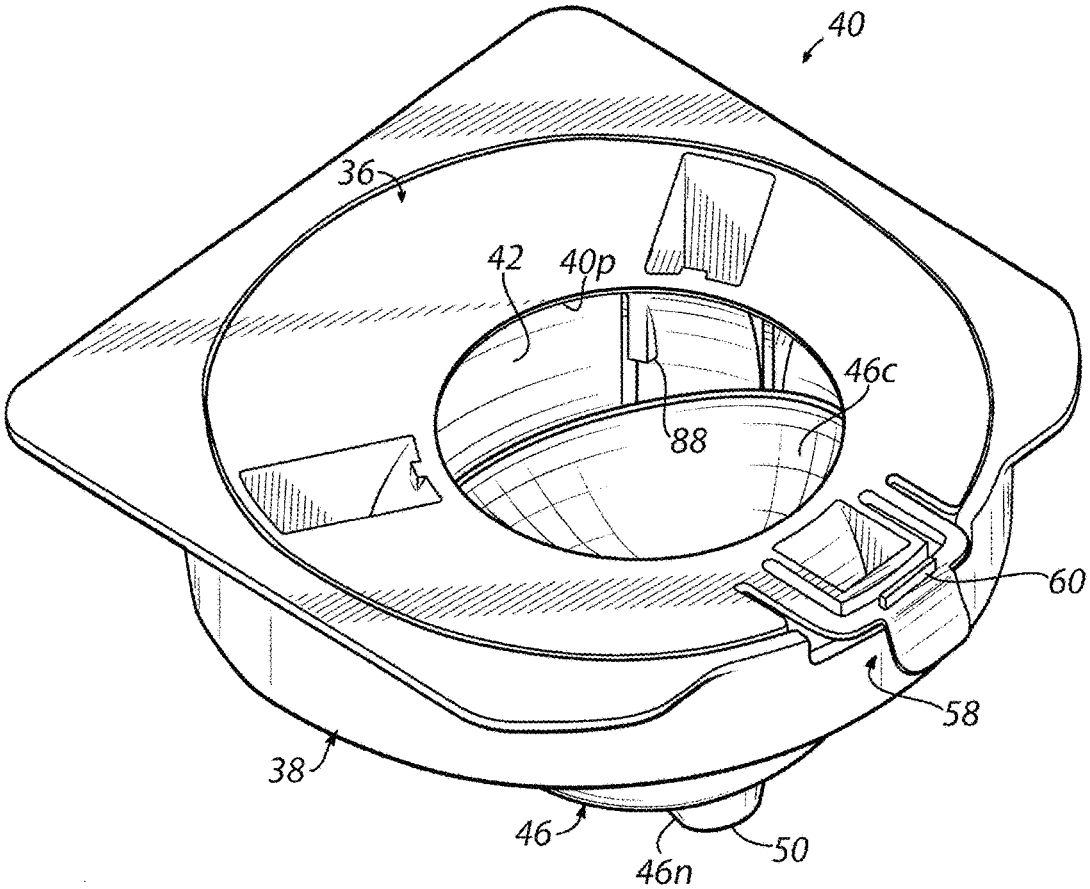
FIG. 5 is a perspective view of the dispensing portion of FIG. 4.
Figure 6:
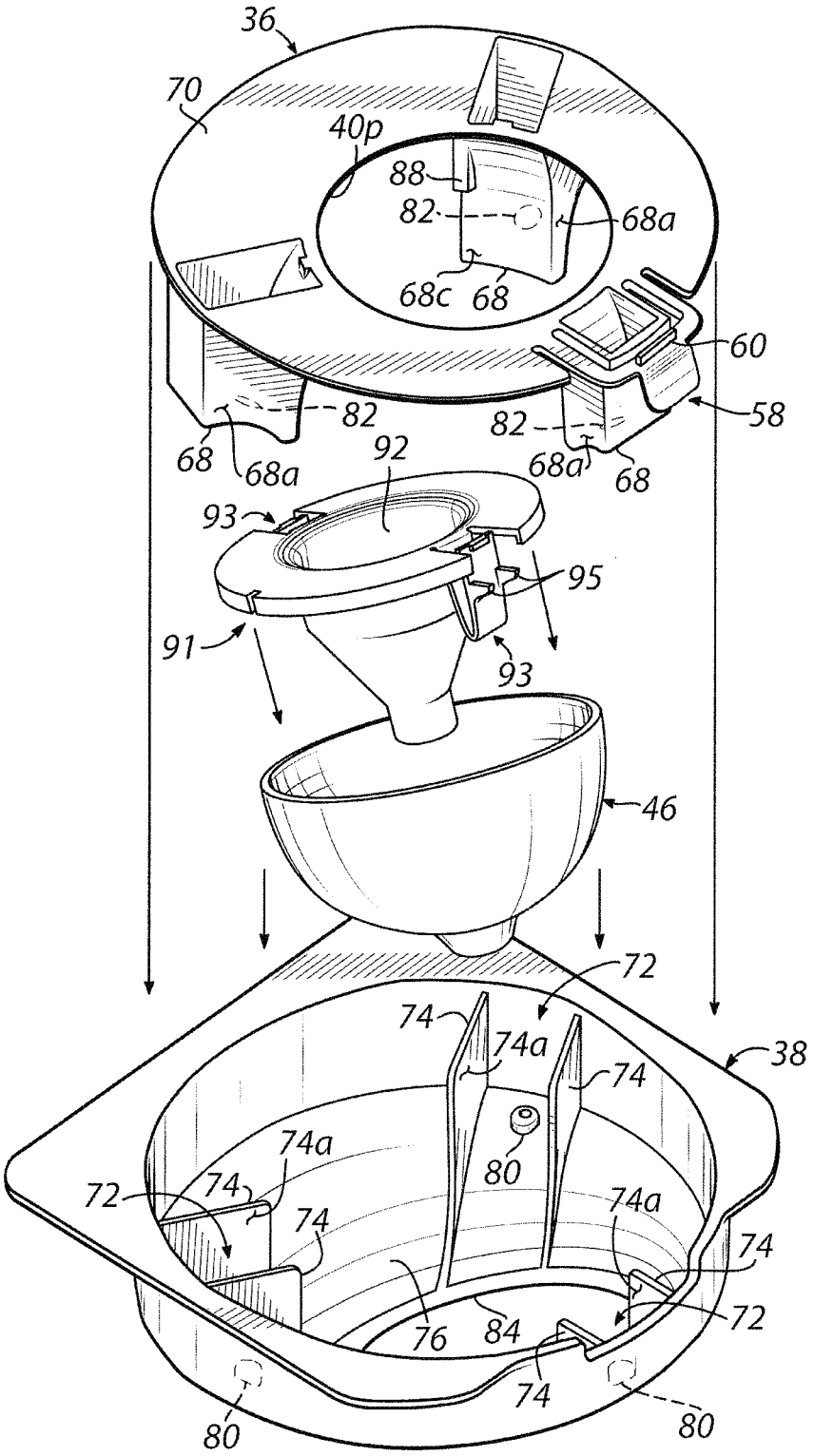
FIG. 6 is a disassembled view of the dispensing portion of FIGS. 4 and 5.

With reference to the figures, and more particularly to FIGS. 1, 2, and 3, an illustrative apparatus in the form of a dispenser 10 is shown for dispensing paper product 11. As used herein, the term "paper product" and related terms refers to a thin substrate made of cellulose fiber paper, and also refers to other dry or moist substrates, made for example of a nonwoven material. In the example embodiment of FIGS. 1-3, the dispenser 10 is a "center-feed" or "center-pull" type dispenser that is configured to dispense paper product 11 from a roll 12 (FIG. 3) housed in the interior 14 of the dispenser 10. The example roll 12 shown in FIG. 3 is wound so that paper product 11 may be dispensed from the center of that roll 12, although dispenser 10 may similarly be used to dispense paper product from rolls configured to dispense paper product 11 tangentially i.e., from the outer surface of the roll, in the manner paper product 11 is dispensed from conventional rolls of paper towel, for example. Paper product 11 may be one continuous web structure with or without perforations or other types of discontinuities between adjacent segments.

Dispenser 10 includes an encasement 16, extending generally along a longitudinal axis 16*x*, and having front and back cooperating housing elements 20, 22 that, when joined, define the interior 14 of dispenser 10. The front housing element 20, in the example embodiment of FIGS. 1-3, is in the form of a door, pivotable between open and closed positions, so as to provide access into interior 14 for loading and unloading rolls 12 of paper product 11. Pivoting motion of front housing element 20 is facilitated by a pair of hinged connections 23 at the interface between adjacent edges of the front and back housing elements 20, 22. A latch (not shown) secures the pivotable front housing element 20 in the closed position, relative to back housing element 22.

The interior 14 is configured to support the roll 12 during dispensing of paper product 11 from the roll 12. More specifically, the interior 14 of encasement 16 has a base 26 at a longitudinal bottom end 16*c* of encasement 16, which includes an inner, upper surface 26*a* that contacts and thereby supports roll 12 during dispensing. It is contemplated that encasement 16 may alternatively be made of a single housing element, and have a loading opening at the top for loading and unloading a roll 12. Similarly, it is also contemplated that encasement 16 could alternatively have housing elements in a number greater than two, such that when joined together, those housing elements would define an encasement capable of supporting a roll 12 in the interior of the dispenser. Alternative embodiments of the type described above are considered to fall within the scope of the present disclosure.

With continued reference to FIGS. 1-3, and referring further to FIGS. 4, 5, 6, 7A, and 7B, dispenser 10 also includes a removable dispensing portion 30, connected to the bottom longitudinal end 16*c* of encasement 16, that has features enabling dispensing of paper product 11 from the roll 12 supported in interior 14 of the dispenser 10. The example dispensing portion 30 is releasably coupled to the encasement 16 to permit easy and quick separation of the dispensing portion 30 and encasement 16 from one another, which may be desirable, for example, to facilitate cleaning of components making up the dispensing portion 30. In the illustrated embodiment, releasable coupling between the dispensing portion 30 and encasement 16, is also free of fasteners such as screws, bolts, nails, rivets, staples, nuts or other fasteners conventionally used to provide coupling between mechanical components. This fastener-free coupling in the illustrated embodiment further facilitates easy and relative quick separation of dispensing portion 30 and encasement 16 from one another. Other forms of releasable coupling may be alternatively used between dispensing portion 30 and encasement 16, including or not including fasteners. It is to be noted, however, that a type releasable coupling that includes one or more fasteners may be desirable so as to hinder separation of the dispensing portion 30 and encasement 16 relative to one another by unauthorized persons.

Dispensing portion 30 includes first and second housing parts 36, 38 that are coupled to one another so as to define a housing 40 having an interior 42. A rotatable dispensing member or dispensing element 46 is releasably retained, in operation, in the interior 42 of housing 40, and includes a dispensing orifice 50 suitably shaped and dimension so as to permit dispensing of paper product 11 from the interior 14 of dispenser 10. To that end, the base 26 includes a base opening 26*p* that is in flow communication with an adjacent housing opening 40*p* of housing 40 and with the dispensing orifice 50. Paper product 11 flows, in operation, from the interior 14 of encasement 16, through base and housing openings 26*p*, 40*p*, and out of dispenser 10 through dispensing orifice 50. In the example embodiment of the figures, the base opening 26*p* and housing opening 40*p* lie on respective planes that are substantially parallel to one another, although it is contemplated that they may instead lie on respective planes that are angled relative to one another.

Figure 7A:
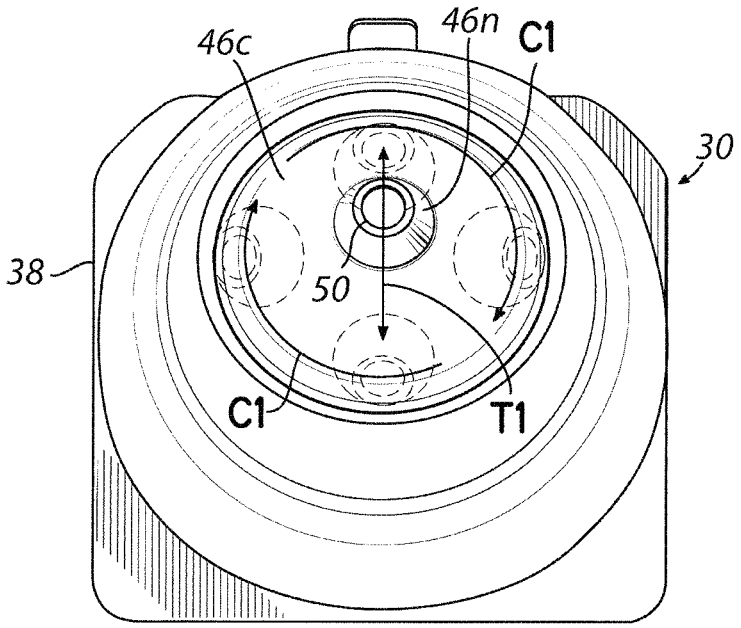
FIG. 7A is a bottom view of the dispensing portion of FIGS. 4-6, illustrating various available orientations of a dispensing element of the dispensing portion.
Figure 7B:
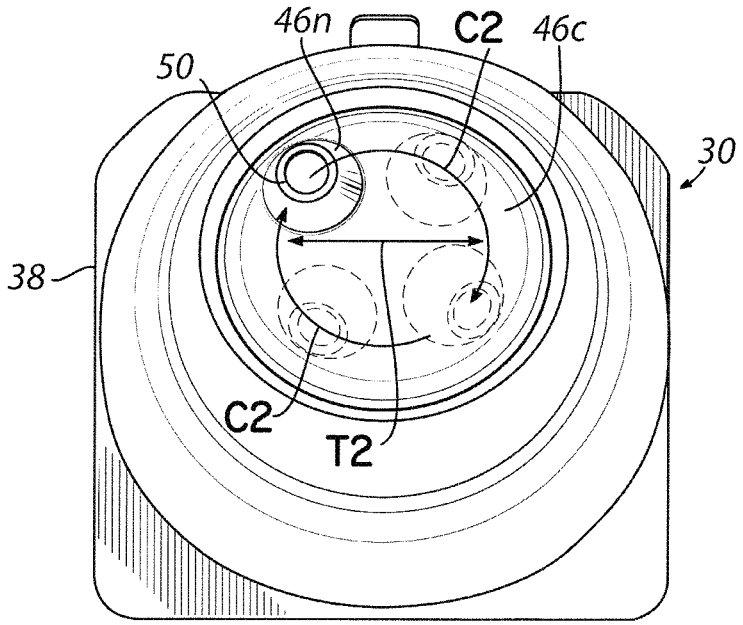
FIG. 7B is a view similar to FIG. 7A, illustrating various other available positions of the dispensing element of the dispensing portion.
Figure 8:
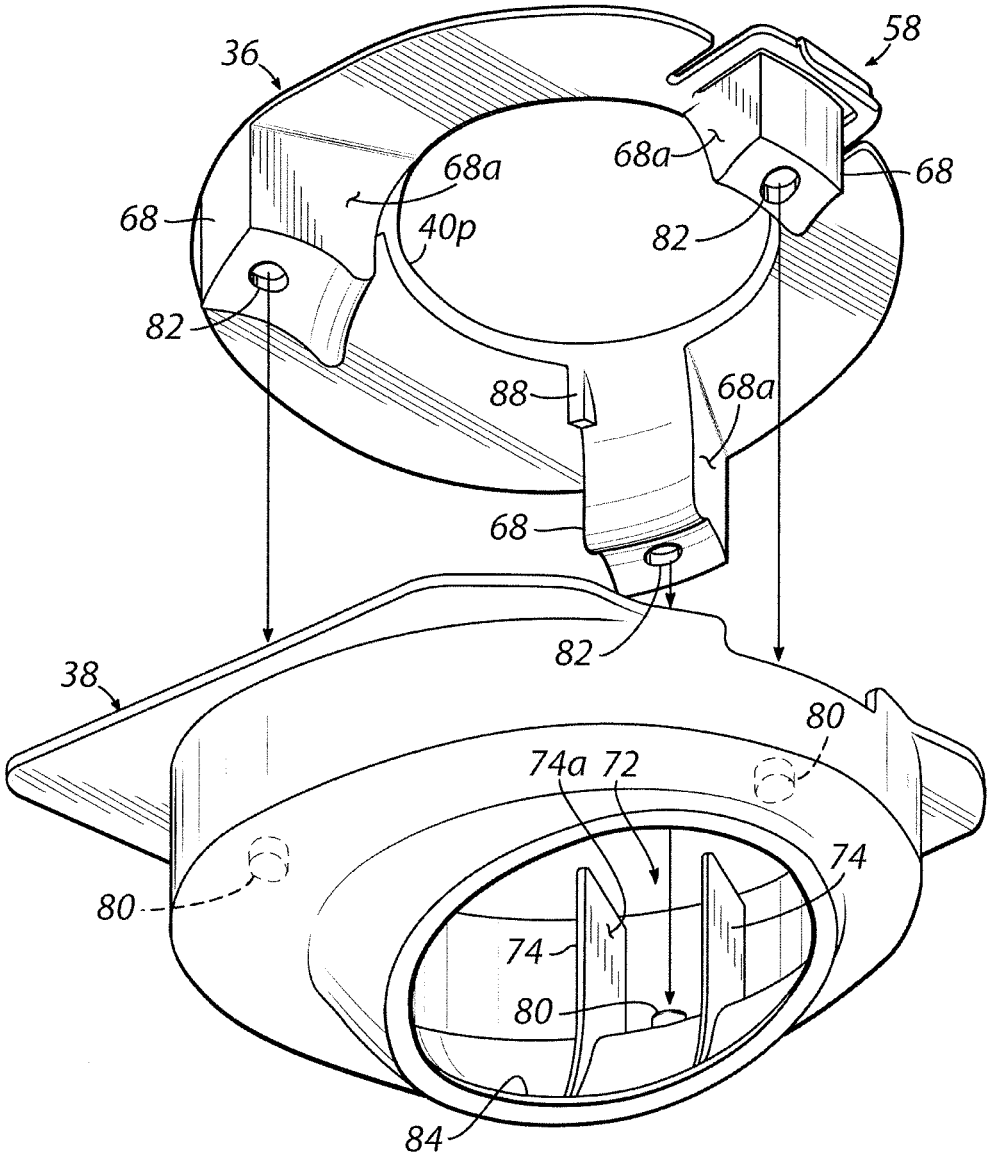
FIG. 8 is a partially disassembled view of a pair of components of the dispensing portion of FIGS. 4-6, 7A, and 7B, illustrating coupling of those components with one another.

As shown particularly in FIGS. 7A and 7B, dispensing element 46 has multiple degrees of freedom to move relative the remainder of dispensing portion 30. Specifically, dispensing element 46 is free to rotate so as to circumscribe two or more circumferences (the circumscribed circumference suggested by arrows C1 being larger than the circumscribed circumference suggested by arrows C2) clockwise and counterclockwise (i.e., the direction suggested by arrows C1, C2, and the opposite direction), as well being free to move translationally along two or more axes, as suggested by the vertical and horizontal arrows T1, T2 in FIGS. 7A and 7B. The freely-moving nature of dispensing element 46 allows the user of the dispenser 10 to orient the paper product 11 at any desired angle before tearing a section of the paper product 11 for use.

In the example embodiment of the figures thus far described, dispensing portion 30 and encasement 16 are slidably and directly coupled to one another, although it is understood that dispensing portion 30 and encasement 16 may alternatively be coupled to one another in non-slidable, direct or indirect fashion. In the illustrative embodiment of FIG. 3, a pair of flange portions 52 of dispensing portion 30 are received and supported by generally L-shaped (in cross-section) ledges 55 that extend from the outer, bottom surface 26*b* of base 26, so as to define a pair of tracks or channels 56 of encasement 16. The flange portions 52 in this embodiment are generally parallel to the bottom surface 26*b* of base 26, although this is merely an example. As shown particularly in FIGS. 9A, 9B, 10A, and 10B, a latch 58 of dispensing portion 30 is effective to selectively restrict (i.e., prevent or at least hinder) or permit outward sliding (or inward sliding) motion of dispensing portion 30 relative to encasement 16 in a direction that is transverse, and more specifically substantially orthogonal to longitudinal axis 16*x*. Specifically, in the illustrated embodiment, the latch 58 includes a protrusion in the form of a tongue 60 that is selectively received within a slot 62 adjacent a front end of base 26, so as to lock the dispensing portion 30 in place, relative to encasement 16.

Figure 9A:
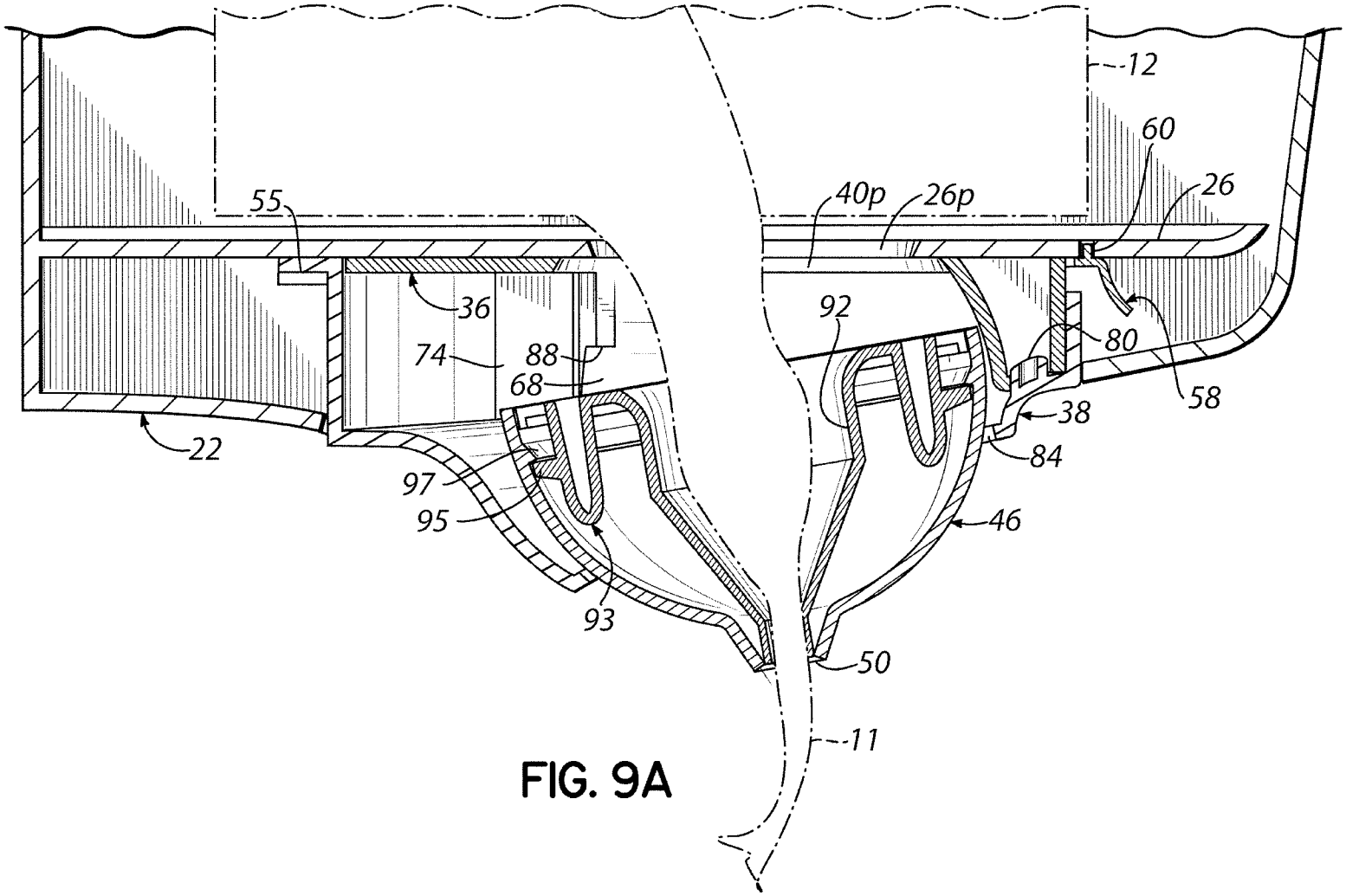
FIG. 9A is a broken-away cross-sectional view taken generally along line 9A-9A of FIG. 1, illustrating a portion of the dispenser therein.
Figure 9B:
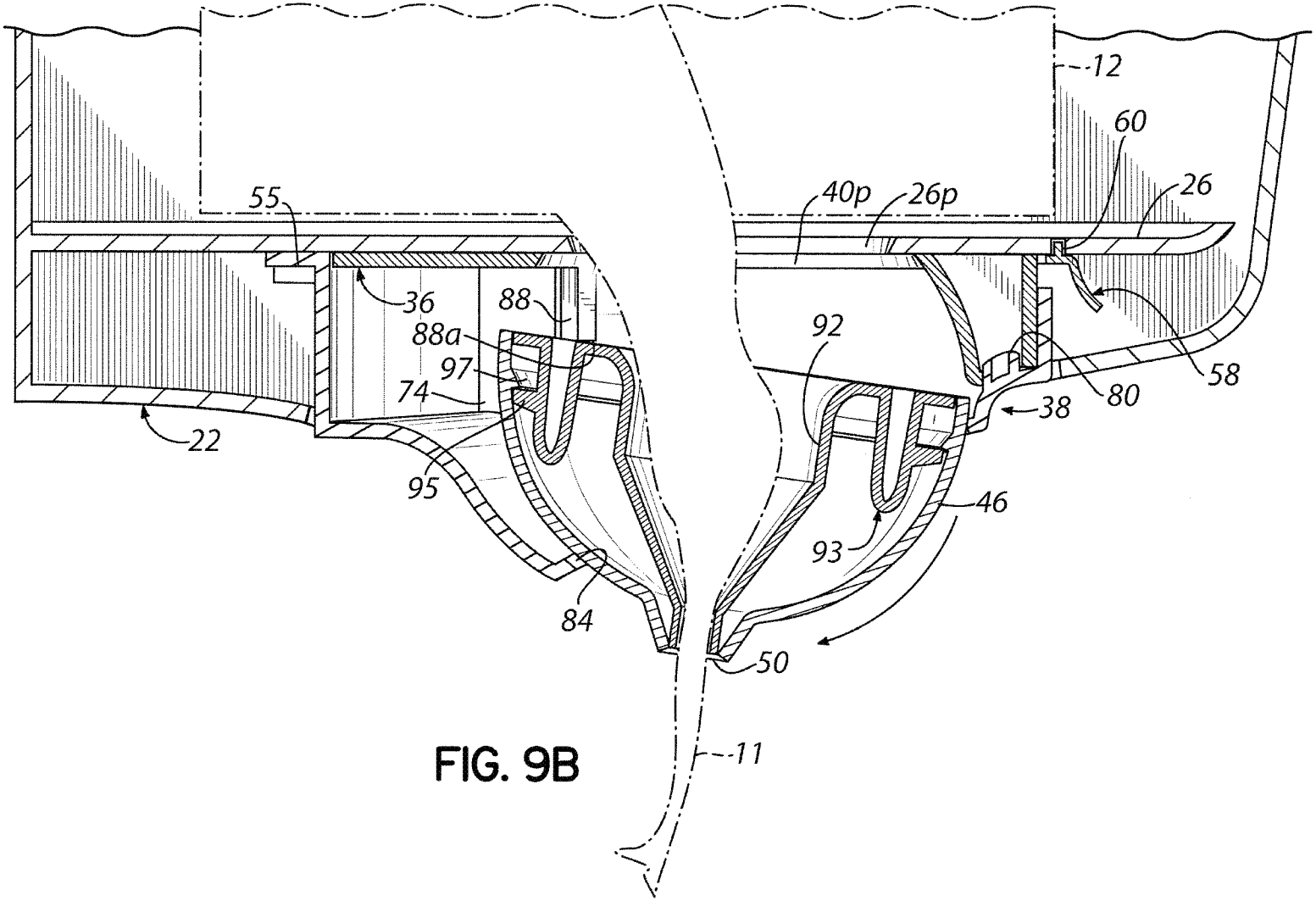
FIG. 9B is a view similar to FIG. 9A, illustrating a dispensing element of the dispenser in a position different from that shown in FIG. 9A.
Figure 10A:
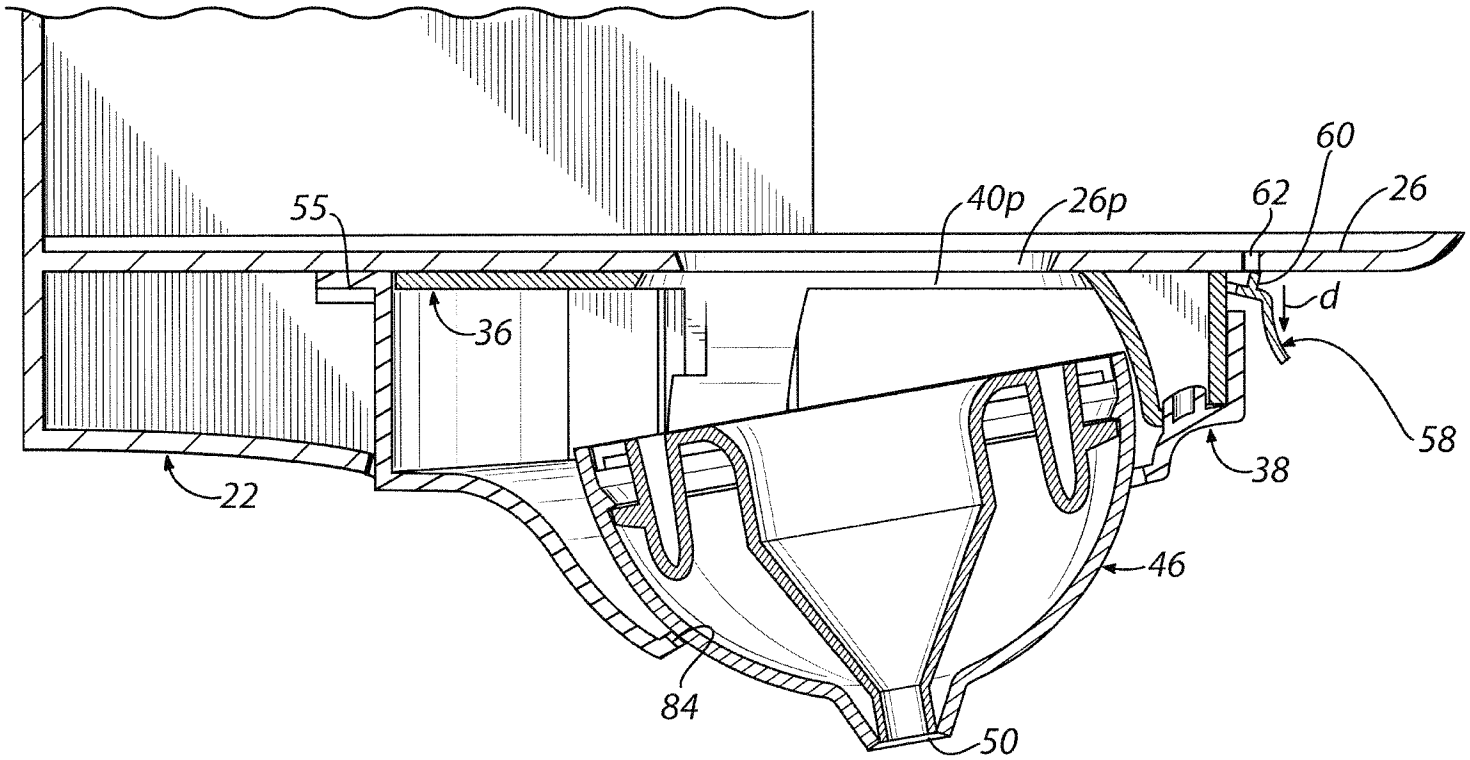
FIG. 10A is a view similar to FIGS. 9A and 9B, illustrating disengagement of a latch of the dispenser in that figure.
Figure 10B:
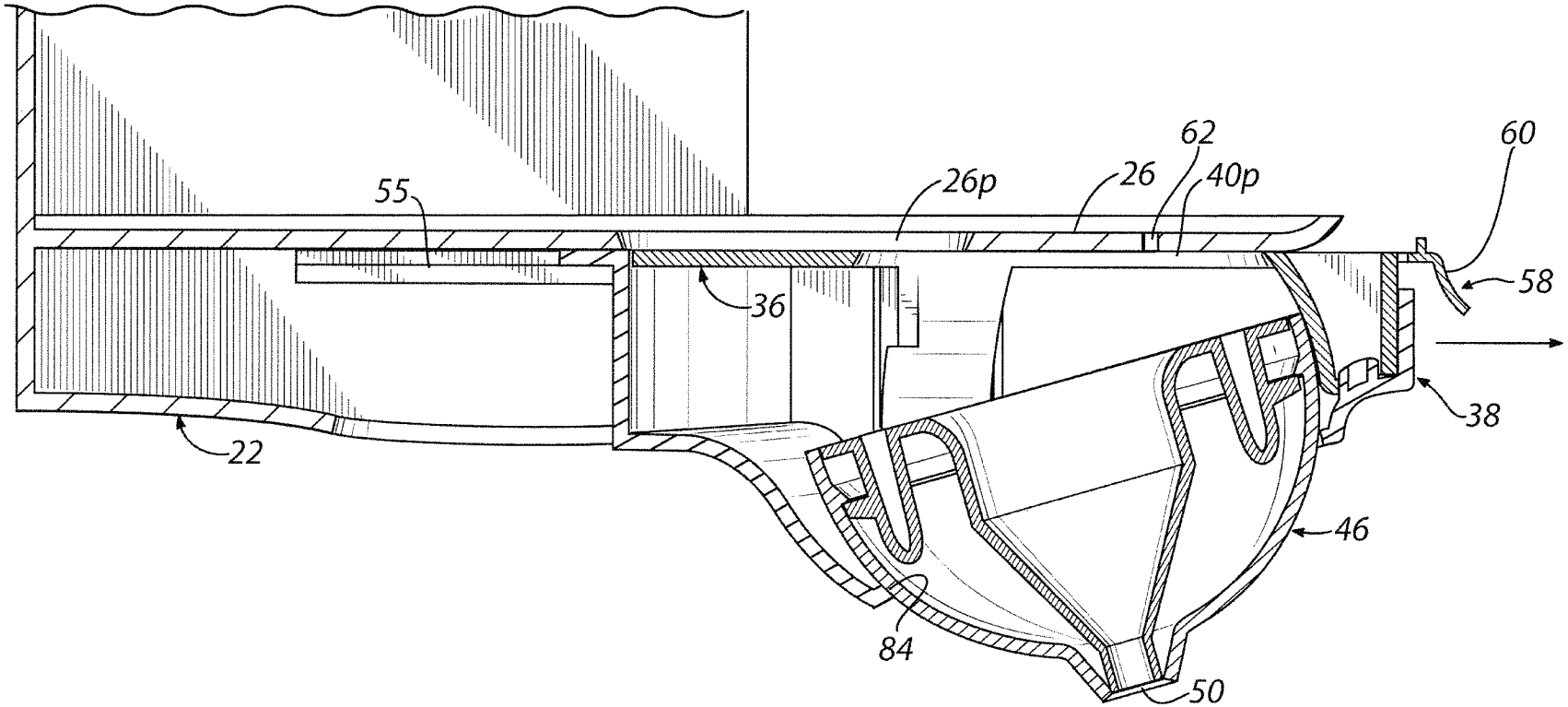
FIG. 10B is a view similar to FIG. 10A, illustrating sliding motion of two components of the dispenser relative to one another.

In FIGS. 9A and 9B, the latch 58 is shown in the locked position, with the tongue 60 being fully received and retained by the slot 62. The engagement of tongue 60 within slot 62 is effective to restrict, and more specifically in this embodiment, to prevent, sliding outward or inward movement of dispensing portion 30 relative to encasement 16. In FIG. 10A, the latch 58 is shown with tongue 60 having been disengaged (arrow d) from slot 62, and sliding movement of dispensing portion 30 being permitted. In FIG. 10B, the dispensing portion 30 is shown in a position different from that of FIGS. 9A, 9B, and 10A, after having slid outward relative to encasement 16. Slidable coupling of dispensing portion 30 to encasement 16 may be desirable to facilitate controlled separation of those two components, along a desired path defined by the engagement of flange portions 52 and channels 56. Latch 58 in the example embodiment of FIGS. 9A, 9B, 10A, and 10B is biased toward the locked position, although it is contemplated that alternatively latch 58 may be biased toward the unlocked position or may not be biased at all. The controlled separation of the dispensing portion 30 and encasement 16 may be advantageous in order to minimize the likelihood of inadvertently breaking one or both components during separation. It is noted, however, that slidable coupling between dispensing portion 30 and encasement 16 may require more space around dispenser 10 that would be necessary for other types of coupling, such as a snap-fit connection. It is understood, accordingly, that slidable coupling between dispensing portion 30 and encasement 16 is merely an example, and not intended to be limiting, insofar as other types of couplings may be present instead or in addition.

As described above, dispensing portion 30 includes first and second housing parts 36, 38 and a rotatable dispensing element 46 retained in the interior 42 of the housing 40 defined by the housing parts 36, 38. In the illustrated embodiment, the first and second housing parts 36, 38 are releasably coupled to one another so as to readily permit their separation, for example, to enable easy cleaning of dispensing portion 30. In the illustrated embodiment, coupling between the first and second housing parts 36, 38 is, in addition to being of the releasable type, free of fasteners, such as screws, bolts, nails, rivets, staples, nuts or other fasteners conventionally used to provide coupling between mechanical components. The fastener-free nature of the coupling between housing parts 36 and 38 further facilitates coupling and decoupling of those components to/from one another. Alternatives are contemplated, however, in which coupling between housing parts 36 and 38 is either not fastener-free, or not releasable at all, for example in order to obtain a dispensing portion 30 that is tamper-proof.

In the example embodiment of FIGS. 1-7, coupling between first and second housing parts 36, 38 is provided by one or more protruding blocks 68, extending from a generally flat ring portion 70 of the first housing part 36, that are slidably received within cooperating channels 72 in an interior of second housing part 38. Each of the channels 72 is defined by a pair of ribs 74 extending from a central portion 76 of the second housing part 38. When received within channels 72, the outer lateral surfaces 68*a* of each protruding block 68 abut against the inner lateral surfaces 74*a* of the pair of ribs 74 making up the respective channel 72. The abutting relationship between outer lateral surfaces 68*a* and inner lateral surfaces 74*a* prevents rotation of the first and second housing parts 36, 38 relative to one another. That abutting relationship also provides frictional engagement between the protruding blocks 68 and the channels 72, effective to at least hinder separation of first and second housing parts 36, 38 from one another.

The second housing part 38 also includes, in the illustrative embodiment of FIGS. 1-7, 9A, 9B, 10A, and 10B one or more bosses 80, extending from the central portion 76, that are slidably received within a corresponding number of apertures 82. Engagement of the bosses 80 within the apertures 82 is effective to further restrict relative movement of the housing parts 36, 38 relative to one another, and further defines a predetermined position of the housing parts 36, 38 in use. It is contemplated that alternative embodiments may have features other than bosses 80 and apertures 82 to carry out a similar function, or have no such features at all. For example, and without limitation, embodiments are contemplated in which engagement of the protruding blocks 68 and channels 72 suffices to restrict movement of the housing parts 36, 38 relative to one another and to define a predetermined position of those parts 36, 38 in use. Other embodiments are similarly contemplated in which first housing part 36 has one or more bosses 80 and second housing part 38 has a corresponding number of apertures 82 that slidably receive the one or more bosses 80 of second housing part 38.

With continued reference to FIGS. 1-7, 9A, 9B, 10A, and 10B, and as explained above, the dispensing element 46 is retained in the interior 42 of the housing 40 defined by the housing parts 36, 38. In the example embodiment of the figures, dispensing element 46 includes a hollow, generally dome-shaped, semispherical body 46*c* and an integrally-formed dispensing nozzle 46*n* that includes the dispensing orifice 50. When the dispensing portion 30 is fully assembled, as shown for example in FIG. 5, the dispensing element 46 is free to rotate freely in interior 42 of housing 40. To that end, movement of the dispensing element 46 in interior 42 is guided by inner arcuate front surfaces 68*c* of the protruding blocks 68 and inner arcuate front surfaces 74*c* of the ribs 74, with those surfaces generally conforming to the outer surface of dispensing element 46. Adjacent inner arcuate surfaces 68*c* and 74*c* cooperate with each another so as to define a continuous arcuate surface for each pair protruding block 68 and corresponding ribs 74. Further, the continuous arcuate surfaces of all pairs, along with the arcuate surface 76*a* of the central portion 76 of second housing part 38 jointly define a dome-shaped cavity that generally conforms to the outer surface of dispensing element 46, thereby defining a predetermined path of movement of dispensing element 46, along that cavity, within interior 42. The generally dome-shaped cavity in interior 42 thus permits free rotation and translational movement of dispensing element 46, as suggested by the various orientations of dispensing element 46 and the resulting various positions of dispensing orifice 50 in FIGS. 7A and 7B.

A portion of dispensing element 46 that includes dispensing orifice 50 protrudes out of the interior 42 through a bottom opening 84 of first housing part 36. Bottom opening 84 in the example embodiment of FIGS. 1-7, 9A, 9B, 10A, and 10B is oriented so as to provide a generally forward-facing position for the dispensing orifice 50, which facilitates dispensing of paper product 11 in a generally forward direction. To that end, bottom opening 84 is designed to lie in a plane P1 that is transverse to and accordingly intersects a plane P2 in which the house opening 40*p* lies, as shown in FIG. 2. Further, as also shown in FIG. 2, bottom opening 84 is oriented such that a central axis 84*x* of opening 84 defines an acute angle $\alpha$ with the longitudinal axis 16*x* of encasement 16. Other relative orientations of opening 84 are similarly contemplated, with those alternatives being considered to fall within the scope of the present disclosure. For example, and without limitation, opening 84 may alternatively be oriented to lie in a plane that is generally parallel to the plane P2 in which the house opening 40*p* lies and/or be oriented such that the central axis 84*x* of opening 84 is generally parallel or even generally orthogonal to the longitudinal axis 16*x* of encasement 16. The materials making defining the outer surface of dispensing element 46, the generally dome-shaped cavity of interior 42, and the edges defining bottom opening 84 of housing 40 are suitably chosen such that the protruding portion of dispensing element 46 can smoothly and freely rotate relative to bottom opening 84.

The range of rotational motion of dispensing element 46 within interior 42 is limited so as to prevent exposure of interior 42 through bottom opening 84. Specifically, and as shown in FIGS. 5, 6, 8, 9A, and 9B, dispensing portion 30 includes one or more stopping elements 88 in interior 42, extending radially inward from one or more of the inner arcuate surfaces 68*c*, that prevent upward rotational movement (counterclockwise in the figure) of dispensing element 46 beyond a predetermined position. FIG. 9A shows the dispensing element 46 in a first position, while FIG. 9B shows dispensing element 46 in a second position, having rotated upward (counterclockwise in the figure), towards the rear of the dispenser 10. As shown in FIG. 9B, the dispensing element 46 abuts against a bottom surface 88*a* of one of the stopping elements 88, with that abutment being effective to prevent further upward (counterclockwise in the figure) movement of dispensing element 46 beyond the position depicted in that figure.

Forward rotational movement (clockwise in FIGS. 9A and 9B) of dispensing element 46 is also restricted beyond a predetermined position. Specifically, the range of upward rotational movement (clockwise in the figures) is limited by engagement (not shown) of an end portion of body 46*c* with the bottom surface 26*b* of base 26. In the example embodiment of FIGS. 1-7, 9A, 9B, 10A, and 10B, the dispensing portion 30 includes two stopping elements 88 and the circumferential location of those stopping elements 88 is such that they are effective to also limit lateral upward rotation of dispensing element 46 (i.e., towards and away from the plane of the paper in those figures), so as to prevent exposure of interior 42 during movement of dispensing element 46.

While the embodiment of FIGS. 1-7, 9A, 9B, 10A, and 10B includes two stopping elements 88, each extending from one of the inner arcuate surfaces 68*c* of a protruding block 68, alternative embodiments are contemplated having a different number of stopping elements 88 and/or located elsewhere in dispensing portion 30 and/or having a circumferential spacing different from that shown.

Referring again to FIGS. 6, 9A, and 9B, those figures illustrate an optional feature in accordance with another embodiment of the invention. The optional feature is in the form of a guiding adaptor 91 having an angled, generally conical guiding surface 92, and configured for releasable, fastener-free coupling with dispensing element 46. Releasable, fastener-free coupling between adaptor 91 and dispensing element 46 is provided, in the non-limiting example embodiment of the figures, by a pair of resilient wings 93, each having a respective pair or ribs 95 that engage a cooperating catch 97 on the interior surface of dispensing element 46. As shown particularly in FIGS. 9A and 9B, the guiding surface 92 facilitates guiding travel of paper product 11 toward dispensing orifice 50. Adaptor 91, in that regard, may be particularly desirable to guide a tail of paper product 11 toward dispensing orifice 50 when a new roll of paper product 11 is placed within the dispenser 10. In the illustrated embodiment, the adaptor 91 has a single, continuous guiding surface 92. Alternative embodiments are contemplated, however, in which the adaptor or similar device has a number of guiding surfaces in a number greater than one, with those surfaces being continuous with one another or spaced from one another.

Example embodiments of the invention are described as follows, in non-limiting fashion:

1. An apparatus for dispensing paper product from a roll of paper, comprising:

an encasement configured to enclose the roll of paper, said encasement having a base at a longitudinal end thereof for supporting the roll of paper therein, said base including a base opening for the paper to be inserted there through, an inner surface configured to contact the roll of paper, and an opposite outer surface; and a dispensing portion adjacent said outer surface of said base and releasably coupled to said encasement, coupling between said dispensing portion and said encasement being free of fasteners, wherein:

said dispensing portion includes a rotatable dispensing element having a dispensing orifice for dispensing paper from within said encasement to the exterior, and said dispensing portion has a housing first opening adjacent and in flow communication with said base opening and in flow communication with said dispensing orifice for receiving the paper there through.

2. The apparatus of clause 1, wherein said dispensing portion is directly coupled to said outer surface of said base.
3. The apparatus of either of clauses 1 or 2, wherein said dispensing portion and said encasement are slidably coupled to one another.
4. The apparatus of clause 3, wherein one of said dispensing portion or said encasement has a pair of flange portions and the other of said dispenser portion or said encasement has a corresponding pair of tracks configured to receive said pair of flange portions there along for sliding movement of said dispensing portion and said encasement relative to one another.
5. The apparatus of clause 4, wherein said dispensing portion includes said pair of flange portions and said encasement includes said pair of tracks.
6. The apparatus of clause 5, wherein said pair of tracks is defined by a pair of ledges extending from said outer surface of said base, each of said ledges having a generally L-shaped cross-section.
7. The apparatus of any of clauses 4-6, wherein said dispensing portion includes a latch for selectively restricting sliding movement of said dispensing portion and said encasement relative to one another, said latch having a first position in which sliding movement of said dispensing portion and said encasement relative to one another is permitted, and a second position in which sliding movement of said dispensing portion and said encasement relative to one another is restricted.
8. The apparatus of clause 7, wherein said latch includes a protrusion and said base includes a slot configured to receive said protrusion therein, said protrusion being biased toward said second position of said latch.
9. The apparatus of any of clauses 1-8, wherein said rotatable dispensing element includes a generally dome-shaped body.
10. The apparatus of any of clauses 1-9, wherein said dispensing portion includes a housing, said rotatable dispensing element being releasably retained within said housing.
11. The apparatus of clause 10, wherein said housing includes first and second housing parts releasably coupled to one another.
12. The apparatus of clause 11, wherein releasable coupling between said first and second housing parts is free of fasteners.
13. The apparatus of either of clauses 11 or 12, wherein said first housing part includes at least one first arcuate guiding surface shaped so as to conform to an outer surface of said rotatable dispensing element and configured to guide movement of said rotatable dispensing element within said housing.
14. The apparatus of clause 13, wherein said first housing part includes a stopping element, extending from said at least one first arcuate guiding surface, configured to restrict movement of said rotatable dispensing element beyond a predetermined position.
15. The apparatus of either of clauses 13 or 14, wherein said second housing part includes at least one second arcuate guiding surface, shaped so as to conform to said outer surface of said rotatable dispensing element, and cooperating with said at least one first arcuate guiding surface of said first housing part, so as to jointly guide movement of said rotatable dispensing element there along.
16. The apparatus of any of clauses 1-15, wherein said dispensing portion includes a housing supporting said rotatable dispensing element therein and having a housing second opening spaced from said housing first opening, said rotatable dispensing element protruding through said housing second opening and being rotatable relative thereto, said housing first and second openings lying on respective first and second planes transverse one another.
17. The apparatus of any of clauses 11-16, wherein said first and second housing parts are slidably coupled to one another.

18. The apparatus of any of clauses 11-17, wherein one of said first or second housing parts includes one or more bosses, and the other of said first or second housing parts includes a corresponding number of apertures configured to receive said one or more bosses therein, so as to guide positioning of said first and second housing parts relative to one another.
19. The apparatus of any of clauses 1-18, wherein said dispensing portion includes a guiding element disposed within said rotatable dispensing element and having one or more angled guiding surfaces for guiding paper from said base opening toward said dispensing orifice.
20. The apparatus of clause 19, wherein said guiding element is releasably coupled to said rotatable dispensing element.
21. An apparatus for dispensing paper product from a roll of paper, comprising:

an encasement configured to enclose the roll of paper, said encasement having a base at a longitudinal end thereof for supporting the roll of paper therein, said base including a base opening for the paper to be inserted there through, an inner surface configured to contact the roll of paper, and an opposite outer surface; and a dispensing portion adjacent said outer surface of said base and slidably coupled to said encasement, wherein:

said dispensing portion includes a rotatable dispensing element having a dispensing orifice at an end thereof for dispensing paper from within said encasement to the exterior, said rotatable dispensing element having multiple degrees of freedom for movement thereof relative to the rest of said dispensing portion, and said dispensing portion has a housing first opening adjacent and in flow communication with said base opening and in flow communication with said dispensing orifice for receiving the paper there through.
22. The apparatus of clause 21, wherein coupling between said encasement and said dispensing portion is free of fasteners.
23. The apparatus of either of clauses 21 or 22, wherein said dispensing portion has a housing second opening, said rotatable dispensing element protruding there through and being rotatable relative thereto, said housing first and second openings lying on respective first and second planes transverse to one another.
24. An apparatus for dispensing paper product from a roll of paper, comprising:

an encasement configured to enclose the roll of paper, said encasement extending along a longitudinal axis and having a base at a longitudinal end thereof for supporting the roll of paper therein, said base including a base opening for the paper to be inserted there through, an inner surface configured to contact the roll of paper, and an opposite outer surface; and a dispensing portion having a dispensing orifice for dispensing paper to the exterior, said dispensing portion being located adjacent said outer surface of said base and being slidably coupled to said encasement for selectively joining and separating said encasement and said dispensing portion relative to one another.
25. The apparatus of clause 24, wherein said dispensing portion includes a rotatable dispensing element that includes said dispensing orifice for dispensing paper to the exterior.
26. The apparatus of either of clauses 24 or 25, wherein slidable coupling between said encasement and said dispensing portion permits slidable movement of said encasement and said dispensing portion relative to one another in a direction transverse to said longitudinal axis.
27. The apparatus of claim 26, wherein slidable coupling between said encasement and said dispensing portion permits slidable movement of said encasement and said dispensing portion relative to one another in a direction substantially orthogonal to said longitudinal axis.

Yet other embodiments are also contemplated for uses of systems, apparatus and/or components as well as methods in connection with any of clauses 1-27, as described above.

From the above disclosure of the general principles of the present invention and the preceding detailed description of exemplifying embodiments, those skilled in the art will readily comprehend the various modifications to which this invention is susceptible. Accordingly, this invention is intended to be limited only by the scope of the following claims and equivalents thereof.

What is claimed is:

1. An apparatus for dispensing paper product from a roll of paper, comprising:

an encasement configured to enclose the roll of paper, said encasement having a base at a longitudinal end thereof for supporting the roll of paper therein, said base including a base opening for the paper to be inserted there through, an inner surface configured to contact the roll of paper, and an opposite outer surface; and a dispensing portion adjacent said outer surface of said base and releasably coupled to said encasement, coupling between said dispensing portion and said encasement being free of fasteners, wherein:

said dispensing portion includes a rotatable dispensing element having a dispensing orifice for dispensing paper from within the encasement to the exterior, and said dispensing portion has a housing first opening adjacent and in flow communication with said base opening and in flow communication with said dispensing orifice for receiving the paper there through.

2. The apparatus of claim 1, wherein said dispensing portion is directly coupled to said outer surface of said base.

3. The apparatus of claim 1, wherein said dispensing portion and said encasement are slidably coupled to one another.

4. The apparatus of claim 3, wherein one of said dispensing portion or said encasement has a pair of flange portions and the other of said dispensing portion or said encasement has a corresponding pair of tracks configured to receive said pair of flange portions there along for sliding movement of said dispensing portion and said encasement relative to one another.

5. The apparatus of claim 4, wherein said dispensing portion includes said pair of flange portions and said encasement includes said pair of tracks.

6. The apparatus of claim 5, wherein said pair of tracks is defined by a pair of ledges extending from said outer surface of said base, each of said ledges having a generally L-shaped cross-section.

7. The apparatus of claim 4, wherein said dispensing portion includes a latch for selectively restricting sliding movement of said dispensing portion and said encasement relative to one another, said latch having a first position in which sliding movement of said dispensing portion and said encasement relative to one another is permitted, and a second position in which sliding movement of said dispensing portion and said encasement relative to one another is restricted.

8. The apparatus of claim 7, wherein said latch includes a protrusion and said base includes a slot configured to receive said protrusion therein, said protrusion being biased toward said second position of said latch.

9. The apparatus of claim 1, wherein said rotatable dispensing element includes a generally dome-shaped body.

10. The apparatus of claim 1, wherein said dispensing portion includes a housing, said rotatable dispensing element being releasably retained within said housing.

11. The apparatus of claim 10, wherein said housing includes first and second housing parts releasably coupled to one another.

12. The apparatus of claim 11, wherein releasable coupling between said first and second housing parts is free of fasteners.

13. The apparatus of claim 11, wherein said first housing part includes at least one first arcuate guiding surface shaped so as to conform to an outer surface of said rotatable dispensing element and configured to guide movement of said rotatable dispensing element within said housing.

14. The apparatus of claim 13, wherein said first housing part includes a stopping element, extending from said at least one first arcuate guiding surface, configured to restrict movement of said rotatable dispensing element beyond a predetermined position.

15. The apparatus of claim 13, wherein said second housing part includes at least one second arcuate guiding surface, shaped so as to conform to said outer surface of said rotatable dispensing element, and cooperating with said at least one first arcuate guiding surface of said first housing part, so as to jointly guide movement of said rotatable dispensing element there along.

16. The apparatus of claim 11, wherein said first and second housing parts are slidably coupled to one another.

17. The apparatus of claim 11, wherein one of said first or second housing parts includes one or more bosses, and the other of said first or second housing parts includes a corresponding number of apertures configured to receive said one or more bosses therein, so as to guide positioning of said first and second housing parts relative to one another.

18. The apparatus of claim 1, wherein said dispensing portion includes a housing supporting said rotatable dispensing element therein and having a housing second opening spaced from said housing first opening, said rotatable dispensing element protruding through said housing second opening and being rotatable relative thereto, said housing first and second openings lying on respective first and second planes transverse one another.

19. The apparatus of claim 1, wherein said dispensing portion includes a guiding element disposed within said rotatable dispensing element and having one or more angled guiding surfaces for guiding paper from said base opening toward said dispensing orifice.

20. The apparatus of claim 19, wherein said guiding element is releasably coupled to said rotatable dispensing element.

21. An apparatus for dispensing paper product from a roll of paper, comprising:

an encasement configured to enclose the roll of paper, said encasement having a base at a longitudinal end thereof for supporting the roll of paper therein, said base including a base opening for the paper to be inserted there through, an inner surface configured to contact the roll of paper, and an opposite outer surface;

a dispensing portion adjacent said outer surface of said base and slidably coupled to said encasement; and a latch configured to selectively permit or restrict sliding movement of said dispensing portion and said encasement relative to one another, wherein:

said dispensing portion includes a rotatable dispensing element having a dispensing orifice at an end thereof for dispensing paper from within said encasement to the exterior, said rotatable dispensing element having multiple degrees of freedom for movement thereof relative to the rest of said dispensing portion, and said dispensing portion has a housing first opening adjacent and in flow communication with said base opening and in flow communication with said dispensing orifice for receiving the paper there through.

22. The apparatus of claim 21, wherein coupling between said encasement and said dispensing portion is free of fasteners.

23. The apparatus of claim 21, wherein said dispensing portion has a housing second opening, said rotatable dispensing element protruding there through and being rotatable relative thereto, said housing first and second openings lying on respective first and second planes transverse to one another.

24. An apparatus for dispensing paper product from a roll of paper, comprising:

an encasement configured to enclose the roll of paper, said encasement extending along a longitudinal axis and having a base at a longitudinal end thereof for supporting the roll of paper therein, said base including a base opening for the paper to be inserted there through, an inner surface configured to contact the roll of paper, and an opposite outer surface; and a dispensing portion having a dispensing orifice for dispensing paper to the exterior, said dispensing portion being located adjacent said outer surface of said base and being slidably coupled to said encasement for selectively joining and separating said encasement and said dispensing portion relative to one another.

25. The apparatus of claim 24, wherein said dispensing portion includes a rotatable dispensing element that includes said dispensing orifice for dispensing paper to the exterior.

26. The apparatus of claim 24, wherein slidable coupling between said encasement and said dispensing portion permits slidable movement of said encasement and said dispensing portion relative to one another in a direction transverse to said longitudinal axis.

27. The apparatus of claim 26, wherein slidable coupling between said encasement and said dispensing portion permits slidable movement of said encasement and said dispensing portion relative to one another in a direction substantially orthogonal to said longitudinal axis.

28. An apparatus for dispensing paper product from a roll of paper, comprising:

an encasement configured to enclose the roll of paper, said encasement having a base at a longitudinal end thereof for supporting the roll of paper therein, said base including a base opening for the paper to be inserted there through, an inner surface configured to contact the roll of paper, and an opposite outer surface; and a dispensing portion adjacent said outer surface of said base and slidably coupled to said encasement, wherein:

slidable motion of dispensing portion and encasement relative to one another is in a direction transverse to the longitudinal axis of the encasement, said dispensing portion includes a rotatable dispensing element having a dispensing orifice at an end thereof for dispensing paper from within said encasement to the exterior, said rotatable dispensing element having multiple degrees of freedom for movement thereof relative to the rest of said dispensing portion, and said dispensing portion has a housing first opening adjacent and in flow communication with said base opening and in flow communication with said dispensing orifice for receiving the paper there through.

* * * * *